US009185935B2

(12) United States Patent
Lewis et al.

(10) Patent No.: US 9,185,935 B2
(45) Date of Patent: Nov. 17, 2015

(54) SMOKING ARTICLE FILTERS

(71) Applicant: BRITISH AMERICAN TOBACCO (INVESTMENTS) LIMITED, London (GB)

(72) Inventors: David Lewis, London (GB); Andrew Davis, London (GB); John Richardson, London (GB); John Major, London (GB); John Sampson, London (GB)

(73) Assignee: British American Tobacco (Invesments) Limited, London (GB)

( * ) Notice: Subject to any disclaimer, the term of this patent is extended or adjusted under 35 U.S.C. 154(b) by 0 days.

(21) Appl. No.: 14/398,627

(22) PCT Filed: May 2, 2013

(86) PCT No.: PCT/GB2013/051137

§ 371 (c)(1),
(2) Date: Nov. 3, 2014

(87) PCT Pub. No.: WO2013/164623

PCT Pub. Date: Nov. 7, 2013

(65) Prior Publication Data

US 2015/0107613 A1 Apr. 23, 2015

(30) Foreign Application Priority Data

May 3, 2012 (GB) ..... 1207779.8

(51) Int. Cl.
*A24D 3/04* (2006.01)
*A24D 3/06* (2006.01)

(Continued)

(52) U.S. Cl.
CPC *A24D 3/062* (2013.01); *A24D 3/04* (2013.01); *A24D 3/048* (2013.01); *A24D 3/061* (2013.01);

(Continued)

(58) Field of Classification Search
USPC ..... 131/332, 331, 334, 341, 345; 493/39, 493/47, 50
See application file for complete search history.

(56) References Cited

U.S. PATENT DOCUMENTS 3,552,400 A * 1/1971 Berger et al. ..... 131/339
2002/0020420 A1 2/2002 Xue et al.

(Continued)

FOREIGN PATENT DOCUMENTS

WO 2005/032287 A2 4/2005
WO 2006/097852 A1 9/2006

(Continued)

OTHER PUBLICATIONS

International Search Report and Written Opinion mailed Oct. 9, 2013 for PCT/GB2013/051142, filed May 2, 2013.

(Continued)

*Primary Examiner* — Dennis Cordray
(74) *Attorney, Agent, or Firm* — N W Poulsen; L A Pinol

(57) ABSTRACT

The present invention relates to improvements in filters for use in smoking articles such as cigarettes, cigars and cigarillos. The improvements, particularly but not exclusively, relate to filter capabilities and to the manufacture of such filters. In one example, a filter for a smoking article comprises randomly oriented discrete short length fibres of absorbent having adsorbent particles dispersed therein. The invention also provides a filter for a smoking article comprising various other filter arrangements including absorbent and/or adsorbent materials.

17 Claims, 8 Drawing Sheets

(51) Int. Cl.

| | |
|---|---|
| ***A24D 3/10*** | (2006.01) |
| ***A24D 3/16*** | (2006.01) |
| ***A24D 3/08*** | (2006.01) |
| ***A24D 3/12*** | (2006.01) |
| ***A24D 3/14*** | (2006.01) |

(52) U.S. Cl.

CPC *A24D 3/063* (2013.01); *A24D 3/08* (2013.01); *A24D 3/10* (2013.01); *A24D 3/12* (2013.01); *A24D 3/14* (2013.01); *A24D 3/16* (2013.01)

(56) References Cited

U.S. PATENT DOCUMENTS

| | | | | |
|---|---|---|---|---|
| 2005/0066980 | A1 | 3/2005 | Crooks | |
| 2006/0219253 | A1 | 10/2006 | Branton et al. | |
| 2008/0314400 | A1 * | 12/2008 | Yang et al. | 131/333 |
| 2010/0006112 | A1 * | 1/2010 | Yang et al. | 131/202 |
| 2011/0023900 | A1 * | 2/2011 | Clarke et al. | 131/332 |
| 2015/0090282 | A1 | 4/2015 | Lewis et al. | |

FOREIGN PATENT DOCUMENTS

| | | | |
|---|---|---|---|
| WO | 2007109892 | A1 | 10/2007 |
| WO | 2009080368 | A1 | 7/2009 |
| WO | 2009093051 | | 7/2009 |
| WO | 2009106374 | A1 | 9/2009 |
| WO | 2010108739 | | 9/2010 |

OTHER PUBLICATIONS

UKIPO Search Report mailed Oct. 31, 2013 for Application No. GB1207779.8, filed May 3, 2012.

Written Opinion of the International Preliminary Examining Authority, mailed May 15, 2014 for PCT/GB2013/051142, filed May 2, 2013.

International Preliminary Report on Patentability, mailed Aug. 22, 2014 for PCT/GB2013/051142, filed May 2, 2013.

International Search Report and Written Opinion, mailed Oct. 8, 2013 for PCT/GB2013/051137, filed May 2, 2013.

International Preliminary Report on Patentability, mailed Jun. 10, 2014 for PCT/GB2013/051137, filed May 2, 2013.

* cited by examiner

SMOKING ARTICLE FILTERS

CLAIM FOR PRIORITY

This application is the National Stage of International Application No. PCT/GB2013/051137, filed May 2, 2013, which in turn claims priority to and benefit of British Patent Application No. GB1207779.8, filed May 3, 2012. The entire contents of the aforementioned applications are herein expressly incorporated by reference.

TECHNICAL FIELD

The present invention relates to improvements in filters for use in smoking articles. Particularly but not exclusively the improvements relate to filter capabilities and to the manufacture of such filters.

BACKGROUND

A known filtering material used in cigarette filters is a continuous tow of filamentary cellulose acetate plasticised with triacetin. The cellulose acetate is gathered together to form a rod which is cut to form individual filter segments. The filter for a smoking article may be made of one segment of filter rod, or may be made from multiple segments, with or without a cavity or spaces between them.

SUMMARY

According to embodiments of the invention, there is provided a filter for a smoking article comprising an adsorbent material dispersed within an absorbent material, wherein the amount of adsorbent material in mg, $C_w$, per mm in length, and the amount of absorbent material in mg, $T_w$, per mm in length, for a filter circumference of about 23 to 25 mm, are in accordance with the range:

$$10 \leq (C_w + T_w) \leq 20.$$

The amount of adsorbent material and the amount of absorbent material, per mm in length for a filter circumference of about 23 to 25 mm, can be selected in accordance with the range:

$$11 \leq (C_w + T_w) \leq 18.$$

The amount of adsorbent material and the amount of absorbent material, per mm in length for a filter circumference of about 23 to 25 mm, can be selected in accordance with the range:

$$12 \leq (C_w + T_w) \leq 17.$$

The filter can comprise:

from 6 mg to 16 mg of adsorbent material per millimetre of length; and from 1.5 mg to 8 mg of absorbent material per millimetre of length, for a filter circumference of about 23 to 25 mm.

The filter can comprise:

from 8 mg to 16 mg of adsorbent material per millimetre of length; and from 3.5 mg to 5 mg of absorbent material per millimetre of length, for a filter circumference of about 23 to 25 mm.

The absorbent material can comprise randomly oriented short length fibres which are held together in the filter without the use of a plasticiser.

The randomly oriented short length fibres can have an average length of from about 5 mm to 20 mm when extended.

The randomly oriented short length fibres can comprise an average fibre denier in the range 5 to 9.

The randomly oriented short length fibres can comprise randomly oriented short length fibres formed from a first material and randomly oriented short length fibres formed from a second material.

The first material can comprise cellulose acetate and the second material can comprise a non-crimped material.

The second material can comprise at least one material selected from polyvinyl alcohol (PVOH), polylactic acid (PLA), poly(ϵ-caprolactone) (PCL), poly(1-4 butanediol succinate) (PBS), poly(butylene adipate-co-terephthalate) (PBAT), starch based materials, paper, aliphatic polyester materials and polysaccharide polymers.

The adsorbent material can comprise particles with an average diameter in the range of approximately 0.1 to 1 mm.

The adsorbent material can comprise activated carbon.

The adsorbent material can comprise at least one selected from an ion exchange resin, CR20, zeolite, silica gel, meerschaum, aluminium oxide (activated or not), carbonaceous resin, magnesium silicate, Sepiolite ($Mg_4Si_6O_{15}(OH)_2.6H_2O$)) or combinations thereof.

The filter can have a pressure drop in the range 3.47 to 4.86 mmWg/mm.

The filter can have a hardness of between 85% and 95% according to the Filtrona filter hardness measure.

According to embodiments of the invention, there is further provided a smoking article comprising a filter as set out above.

BRIEF DESCRIPTION OF THE DRAWINGS

Embodiments of the invention will now be described, by way of example only, with reference to the accompanying drawings, in which.

DETAILED DESCRIPTION

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products. Such smoking articles may be provided with a filter for the gaseous flow drawn by the smoker.

Smoking articles such as cigarettes and their formats are often named according to the cigarette length: "regular" (typically in the range 68-75 mm, e.g. from about 68 mm to about 72 mm), "short" or "mini" (68 mm or less), "king-size" (typically in the range 75-91 mm, e.g. from about 79 mm to about 88 mm), "long" or "super-king" (typically in the range 91-105 mm, e.g. from about 94 mm to about 101 mm) and "ultra-long" (typically in the range from about 110 mm to about 121 mm).

They are also named according to the cigarette circumference: "regular" (about 23-25 mm), "wide" (greater than 25 mm), "slim" (about 22-23 mm), "demi-slim" (about 19-22 mm), "super-slim" (about 16-19 mm), and "micro-slim" (less than about 16 mm). Accordingly, a cigarette in a king-size, super-slim format will, for example, have a length of about 83 mm and a circumference of about 17 mm. Cigarettes in the regular, king-size format are preferred by many customers, namely with a circumference of from 23 to 25 mm and an overall length of from 75 to 91 mm.

Each format may be produced with filters of different lengths, smaller filters being generally used in formats of smaller lengths and circumferences. Typically the filter length will be from 15 mm, associated with short, regular formats, to 30 mm, associated with ultra-long super-slim formats. The tipping paper will have a greater length than the filter, for example from 3 to 10 mm longer.

Figure 1:
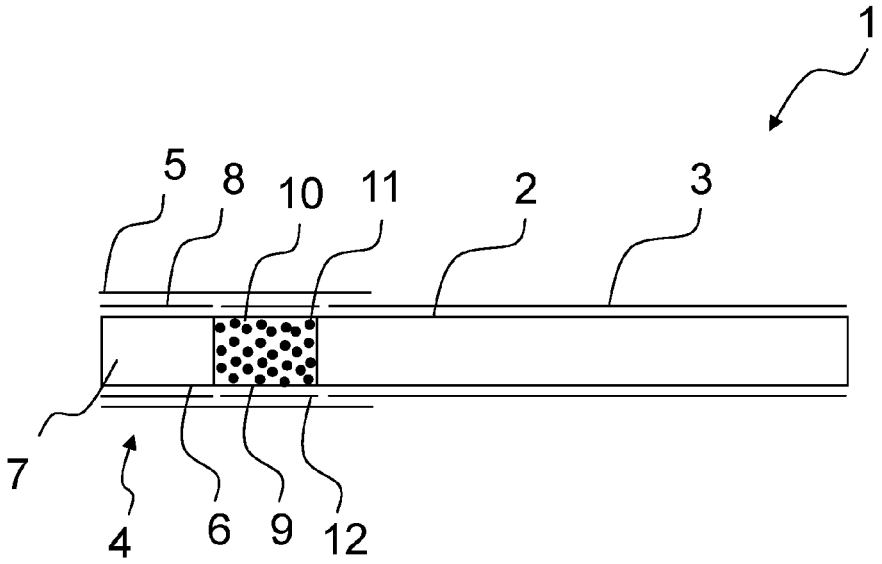
FIG. 1 is a schematic illustration of a smoking article having a filter with at least one segment having from 12 mg of adsorbent material per millimetre of length and 4 mg of absorbent material per millimetre of length, for a regular format filter.

FIG. 1 is a schematic illustration of a smoking article 1 having a filter. The smoking article 1 is in the regular, king size format, namely having a length in the range 75-91 mm and a circumference in the range 23 to 25 mm. The smoking article 1 includes a tobacco rod 2 wrapped in a wrapping material 3, in this case cigarette paper, connected longitudinally to a filter 4 by tipping material 5 overlaying the filter 4 and partially overlaying the wrapping material 3. The filter 4 comprises a first segment 6 at the mouth-end of the filter 4 comprising crimped cellulose acetate tow 7 wrapped in a first plug wrap 8, and a second segment 9 at the tobacco rod end of the filter 4 comprising absorbent material 10 having an adsorbent material 11 dispersed therein and wrapped in a second plug wrap 12.

The first segment 6 is a cellulose acetate segment formed using continuous cellulose acetate fibres and a plasticiser.

The absorbent material 10 of the second segment 9 comprises randomly oriented discrete short length cellulose acetate fibres and the adsorbent material 11 comprises activated carbon particles. The randomly oriented discrete short length cellulose acetate fibres of the second segment 9 are non-plasticised fibres. The randomly oriented discrete short length cellulose acetate fibres of the second segment 9 comprise 8 denier, 10 mm fibre lengths. However, other denier fibres or fibre lengths can be used. For instance, fibre deniers in the range 5 to 9 or 7 to 9 can be used. In terms of fibre length, when used herein, the term 'short length' means fibre lengths of fibres in the form used in a filter segment (i.e. crimped or uncrimped as appropriate) which are shorter than the length of the filter segment. Average fibre lengths (when the fibres are extended) in the range from 5 mm to 25 mm, or from 6 mm to 20 mm, 7 mm to 20 mm or 7 mm to 15 mm can be used. The activated carbon particles are in the present example coconut carbon provided in a 30/70 mesh size, although other carbons and/or sizes can be used. For instance, particles with diameters in the range of approximately 0.1 to 1.0 mm, or approximately 0.2 to 0.9 mm, 0.2 to 0.8 mm, 0.2 to 0.7 mm, 0.2 to 0.6 mm, 0.3 to 0.9 mm, 0.3 to 0.8 mm, 0.3 to 0.7 mm or 0.3 to 0.6 mm can be used.

The second segment 9 has 12 mg of adsorbent material per millimetre of length and 4 mg of absorbent material per millimetre of length. However, in alternative examples, the amount of adsorbent can be anywhere in the range from 6 mg to 16 mg per mm length on average, or from 7 mg to 16 mg, 8 mg to 16 mg, 9 mg to 16 mg, 10 mg to 16 mg, 11 mg to 16 mg, 12 mg to 16 mg, or 13 mg to 16 mg per mm length and the amount of absorbent can be from 1.5 mg to 8 mg per mm length on average, or from 1.5 mg to 7 mg, 1.5 mg to 6 mg, 1.5 mg to 5 mg, or 1.5 mg to 4 mg, all of these ranges being for a regular format filter, i.e. having a circumference of about 23 to 25 mm. It has been found that these parameters enable the filter to exhibit desirable pressure drop and hardness levels for consumer acceptable smoking articles, while increasing the level of adsorbent or other granular additive in the filter over known filters.

The filter material of the second segment 9, for instance, exhibits desirable pressure drop in the range 500 to 700 mmWg for an experimental sample having a 144 mm filter length (3.47 to 4.86 mmWg/mm) and desirable hardness of between 85% to 95% according to the Filtrona filter hardness measure (defined as the compressed diameter of the filter rod as a percentage of the initial rod diameter, the compression of the rod being caused by a known weight applied through a circular foot for a specific period of time). Alternative weights of adsorbent material and absorbent material per mm of filter length would be used for filters in formats other than regular, for instance having slimmer or wider average diameters, as would be appreciated by those skilled in the art.

An increase in the pressure drop and/or hardness percentage resulting from an increase in the amount of adsorbent per mm in a filter can be offset by a decrease in the amount of absorbent per mm. Also, an increase in the pressure drop and/or hardness percentage resulting from an increase in the amount of absorbent per mm in a filter can be offset by a decrease in the amount of adsorbent per mm. The inventors have, in particular, found that the amount of adsorbent material in mg, $C_w$, per mm in length for a regular format smoking article, and the amount of absorbent material in mg, $T_w$, per mm in length for a regular format smoking article, can be determined in accordance with the range:

$$10 \leq (C_w + T_w) \leq 20,$$

these values enabling the filter to exhibit appropriate levels of filter pressure drop and hardness, such as those discussed above.

Particular benefits can be achieved if the amount of adsorbent material and the amount of absorbent material in mg per mm of length for a regular circumference smoking article fall within the range:

$$11 \leq (C_w + T_w) \leq 18,$$

or more particularly within the range:

$$12 \leq (C_w + T_w) \leq 17.$$

Advantages can also be achieved using adsorbent and absorbent weights, in mg per mm of length for a regular circumference smoking article, in other ranges, including $10 \leq (C_w + T_w) \leq 19$, $10 \leq (C_w + T_w) \leq 18$, $10 \leq (C_w + T_w) \leq 17$, $11 \leq (C_w + T_w) \leq 20$, $12 \leq (C_w + T_w) \leq 20$, $13 \leq (C_w + T_w) \leq 20$ and $14 \leq (C_w + T_w) \leq 20$.

In addition to selected adsorbent and absorbent weights per mm falling within the above ranges, at least one of the adsorbent and absorbent weight $C_w$, $T_w$ can be greater than a minimum level. For instance, the absorbent level can be equal to or greater than about 1.5 mg per mm in some embodiments of the invention and/or the adsorbent can be equal to or greater than 6 mg per mm, both minimum levels being for a regular circumference filter, of about 23 mm to 25 mm.

The above ranges can also be applied for use with granular additives other than adsorbents, such as certain flavourants (where local regulations permit).

The second filter segment 9 can be manufactured using a filter manufacturing apparatus such as the Turmalin apparatus available from Hauni Maschinenbau AG in Germany.

In cases in which the absorbent weight per mm is less than 3.5 mg per mm and/or the adsorbent weight per mm is less than 9 mg per mm (both for a regular circumference smoking article), and/or the combined adsorbent and absorbent weight per mm is at the lower end of the above ranges, for instance 12 mg per mm or lower, the inventors have determined that a reduction in hardness caused by these low weights can be offset by using, for instance, a stiffer plug wrap and/or stiffer tipping material surrounding the filter. For instance, the plug wrap and/or tipping could have a basis weight of greater than 30 $g/m^2$, greater than 40 $g/m^2$, greater than 50 $g/m^2$, greater than 60 $g/m^2$, greater than 70 $g/m^2$ or greater than 80 $g/m^2$. Alternatively, multiple layers of plug wrap and/or tipping material can be used.

Known Dalmatian filters, i.e. those comprising carbon particles dispersed in continuous cellulose acetate tow cut according to the required segment length, in the regular format, generally have an upper carbon loading limit of 5 mg/mm in order to keep the pressure drop at levels desirable for consumers. Higher loading could result in the pressure drop being too high. If it was desired to have a higher loading then, in the past, it was usually necessary to use a cavity triple filter, having mouth-end and tobacco end cellulose acetate tow sections with a carbon filled cavity between them. Such cavity filters result in the removal of a quantity of cellulose acetate for a given filter length and so this can have a negative effect, for instance on particular aspects of tar filtration and phenol selectivity. As such, there are clear advantages to being able to increase the loading of additives without causing too great a pressure drop and without the removal of filtration material.

The present inventors accordingly have recognised that by using randomly oriented discrete short length cellulose acetate fibres for forming the filter, manufactured using a filter manufacturing apparatus such as the Turmalin apparatus available from Hauni Maschinenbau AG in Germany, and by selecting the amount of adsorbent to be in the range from 6 mg to 16 mg per mm on average, and the amount of absorbent to be in the range from 1.5 mg to 8 mg per mm on average (or the other ranges and limits set out above), for a regular circumference cigarette, improved filters can be provided whilst maintaining acceptable pressure drop and filter hardness parameters.

Figure 2:
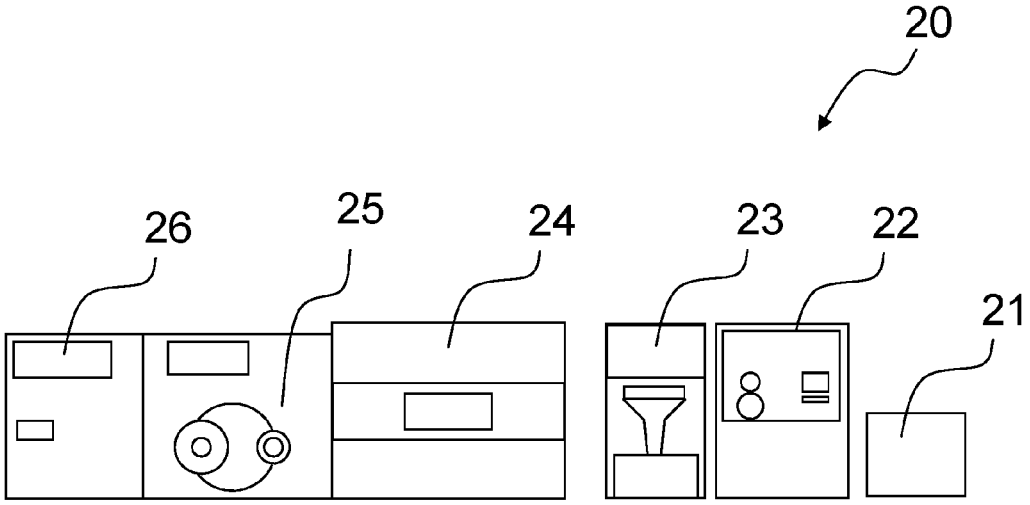
FIG. 2 is a schematic illustration of a filter making apparatus for use in manufacturing filters as set out herein.

FIG. 2 is a schematic illustration of a filter making apparatus, such as the Turmalin apparatus available from Hauni Maschinenbau AG in Germany, for use in manufacturing filters.

Referring to FIG. 2, a source 21 of cellulose acetate or other filter material is supplied to the filter making apparatus 20, which comprises a plurality of modules 22-26. A feeder module 22 receives the supply of filter material, for instance crimped continuous fibres such as crimped cellulose acetate tow, from which it is fed into a cutter and randomiser 23. The cutter and randomiser 23 cuts the filter material into short staple lengths, for instance 10 mm lengths. Other fibre lengths can be used, as described above in relation to the smoking article 1 described with reference to FIG. 1. A filter bander 24 includes a vacuum band onto which the cut filter material is provided. This is fed into a rod former 25, for forming the band of cut filter material into a rod which is wrapped with a plug wrap. Finally, a segment cutter 26 is used to cut the rod into filter segments of a desired length.

The filter bander 24 comprises a carding unit which distributes the cut fibres evenly onto the vacuum band, and a plurality of hoppers, two in the present example, for applying additives, for instance in the form of granules or additional fibres. There is also an add-back system which can be used if required to feed a third additive into the band of cut filter material. The add-back system alternatively may be used to feed any loose cut filter material back into the cutter and randomiser 23 to reduce wastage. The filter bander 24 comprises metering rollers which are adjustable to permit control over the additive loading and to ensure uniformity of the band of cut filter material as it is formed. The filter bander 24 also comprises a jet inserter for enabling liquids such as flavours (where local regulations permit the use of flavours) to be injected directly into the filter rod.

In use, the Turmalin apparatus operates as follows: the feeder module 22 feeds filter material such as crimped cellulose acetate tow into the cutter and randomiser 23. The cutter and randomiser 23 cuts the tow fibres into short staple lengths of 10 mm in the present example. The cut filter material is blown to the carding unit of the filter bander 24 from which it is sucked onto the vacuum band, where it is formed into a band of randomly orientated filter material. The bander 24 operates in such a way that the resultant band of filter material is mechanically bonded. Additives are fed into the air stream carrying the filter fibres, and the rod former 25 forms the band into a continuous filter rod, which is bound by a filter plug wrap. The segment cutter 26 cuts the continuous filter rod, comprising randomly orientated fibres, into segments of a desired length.

Appreciated advantages of the Turmalin apparatus include: the inclusion of additives, for example carbon, at higher loadings; retention of the activity of carbon additives because without plasticisers such as triacetin there is no poisoning of the charcoal; and a longer product life. The filter designs and manufacturing developments created by the inventors which are described below lead to further advantages and improvements.

It is possible to generate a series of filter capability curves for differing tow weights, additive loadings and machinery operating speeds, such that filter designs can be optimised to desired filter characteristics, such as pressure drop and hardness level. This thereby increases the range of different filters which can be manufactured, and which may have purposely different capabilities depending on the requirements for a particular product.

Figure 3:
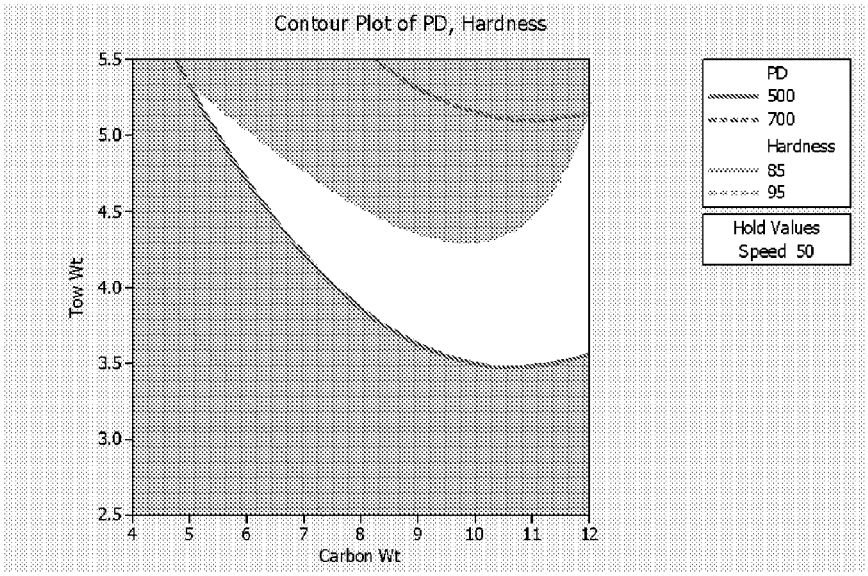
FIG. 3 is a graph illustrating the carbon weight and tow weight in filters based on desired ranges for filter pressure drop and hardness.

FIG. 3 is a graph illustrating the additive weight (in the present case carbon weight) and tow weight in filters based on preferred ranges for their pressure drop and hardness. In particular, the tow weight and carbon weight required for a filter pressure drop of from 500 to 700 mmWg for a 144 mm filter length (3.47 to 4.86 mmWg/mm) and for a filter hardness level from 85% to 95%, according to the Filtrona filter hardness measure, are indicated in the graph, which represents data from filters produced using the Hauni Turmalin apparatus. The device can be operated at speed settings from below 50 m/min up to over 200 m/min. The carbon used was 30/70 mesh coconut carbon, dispersed within 8 denier non-plasticised, crimped randomly oriented cellulose acetate tow fibres cut to 10 mm lengths. For these particular filter parameters, the resulting contour plot of FIG. 3 illustrates the range of tow and carbon weights per mm for a regular circumference smoking article which can be obtained while achieving desired characteristics such as pressure drop and hardness within predefined ranges.

Figure 4:
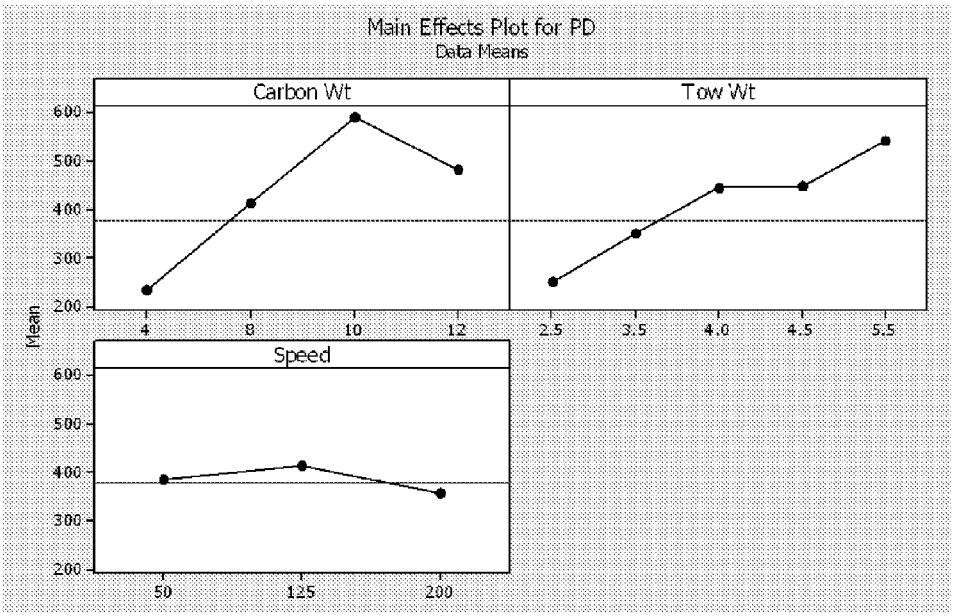
FIG. 4 provides three graphs respectively illustrating the influence of carbon weight, tow weight and machinery operating speed on pressure drop for filters.

In relation to the pressure drop of the filter, FIG. 4 is a graph illustrating the influence of carbon weight, tow weight and machinery operating speed on pressure drop for filters. Again, the carbon used was 30/70 mesh coconut carbon, dispersed within 8 denier non-plasticised, crimped randomly oriented cellulose acetate tow fibres cut to 10 mm lengths. While the operating speed of the machinery has relatively little effect on the pressure drop and the tow weight has a generally linear relationship, surprisingly the inventors have realised that an increased carbon weight beyond 10 mg/mm can be shown in some cases to reduce filter pressure drop for a given tow density, based on filters manufactured using the Turmalin apparatus. This is a significant result, indicating that the level of carbon can be increased beyond 10 mg/mm without having an adverse influence on filter pressure drop.

Figure 5:
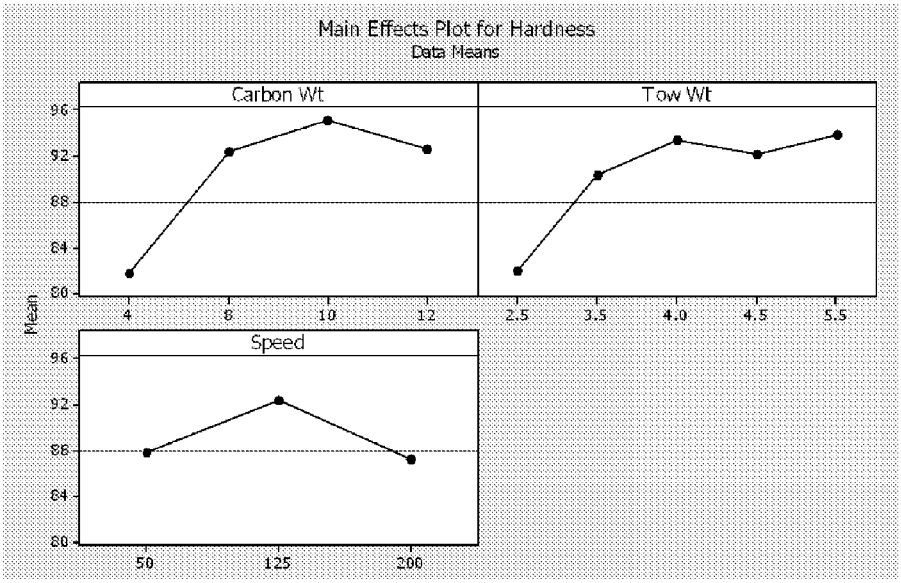
FIG. 5 provides three graphs respectively illustrating the influence of carbon weight, tow weight and machinery operating speed on hardness for filters.

In relation to the hardness of the filter, FIG. 5 provides three graphs illustrating the influence of carbon weight, tow weight and machinery operating speed on hardness for filters. Again, the carbon used was 30/70 mesh coconut carbon, dispersed within 8 denier non-plasticised, crimped randomly oriented cellulose acetate tow fibres cut to 10 mm lengths. In a similar way to pressure drop, while the operating speed of the machinery has relatively little effect on the hardness and the tow weight has a generally linear relationship, surprisingly the inventors have realised that an increased carbon weight beyond 10 mg/mm in fact reduces filter hardness for a given tow density for filters manufactured using the Turmalin apparatus. This is a significant result, indicating that the level of carbon can be increased beyond 10 mg/mm without having an adverse influence on filter hardness.

Although the additive in the above embodiments has been described as particles of adsorbent, in particular activated carbon, other adsorbents, or other additives, can also be used. For instance, the adsorbent could be an ion exchange resin, such as CR20, or other materials such as zeolite, silica gel, meerschaum, aluminium oxide (activated or not), carbonaceous resin, magnesium silicate, including Sepiolite ($Mg_4Si_6O_{15}(OH)_2.6H_2O$) or combinations thereof with or without activated carbon. Also, other additives which modify the smoke drawn through the filter, such as flavourant (where local regulations permit the use of flavourants) for example menthol crystals, or humectant particles, can be used.

It has previously been known to manufacture filters comprising randomly oriented discrete tow fibres, for example as described in WO 2009/093051. However, similar to conventional acetate tow filters, the manufacturing technique described in WO 2009/093051 can also require the use of a plasticising agent, e.g. triacetin, to cause bonding within the randomly orientated fibres to give a firm structure. An advantage of the Turmalin apparatus is that it does not require the use of a plasticising agent. The Turmalin apparatus causes a mechanical bonding within the fibres making the need for plasticiser obsolete. Any undesirable effects caused by using products such as triacetin are therefore eliminated.

In addition to the above advantage, the present inventors have appreciated that the Turmalin apparatus, or similar, enables various filter designs to be made which offer additional improvements and advantages. Such improvements and advantages are described in detail below.

The inventors have appreciated that the capabilities of the filters manufactured using a process such as that of the Turmalin apparatus can be improved by using materials with smaller particle sizes than traditionally used. Smaller particles can enhance that filtration performance because they have larger surface area.

Figure 6:
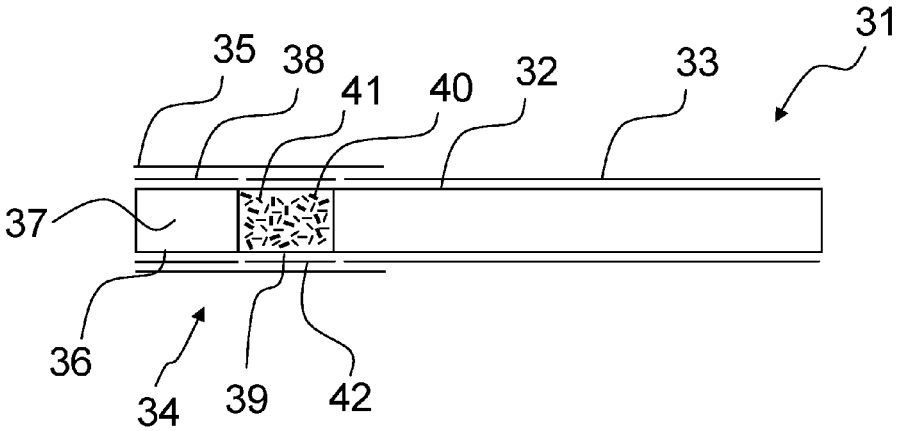
FIG. 6 is a schematic illustration of a smoking article having a filter with a first fibrous filter material having an average fibre denier in the range 7 to 9 and a second fibrous filter material, dispersed within the first fibrous filter material, having an average fibre denier of below 7.

FIG. 6 is a schematic illustration of a smoking article 31. The smoking article 31 comprises a tobacco rod 32 wrapped in a wrapping material 33, in this case cigarette paper, connected longitudinally to a filter 34 by tipping material 35 overlaying the filter 34 and partially overlaying the wrapping material 33. The filter 34 comprises a first segment 36 at the mouth-end of the filter 34 comprising crimped cellulose acetate tow 37 wrapped in a first plug wrap 38, and a second segment 39 at the tobacco rod end of the filter 34 comprising a first absorbent material 40 and a second absorbent material 41 wrapped in a second plug wrap 42.

The first segment 36 is a cellulose acetate segment formed using continuous cellulose acetate fibres and a plasticiser.

The first absorbent material 40 comprises a fibrous filter material having an average fibre denier in the range 7 to 9 and the second absorbent material 41, dispersed within the first absorbent material 40, comprises a fibrous filter material having an average fibre denier of below 7, for instance a denier of about from 1 to 6, 2 to 6, 3 to 6, or about 6, 5, 4 3, 2 or 1. The first and second fibrous filter materials 40, 41 comprise short length fibres which are randomly oriented in the filter.

The second filter segment 39 can be manufactured using the Turmalin apparatus, for instance by supplying a continuous tow of the first absorbent material 40 to the feeder 22 and by adding fibres of the second absorbent material via one of the additive hoppers in the filter bander 24. Alternatively, supplies of the first and second filter materials 40, 41 can each be provided to the feeder 21 of the Turmalin apparatus, such that they are cut and randomised together and processed in a similar way to a single filter material.

The fibres of the first and second materials 40, 41 comprise discrete short length cellulose acetate fibres (as described herein) in the present example, although alternative fibres can also be used. For instance, the fibres of the first and/or second material can comprise cellulose acetate, polyvinyl alcohol (PVOH), polylactic acid (PLA), poly(ϵ-caprolactone) (PCL), poly(1-4 butanediol succinate) (PBS), poly(butylene adipate-co-terephthalate) (PBAT), starch based materials, paper, aliphatic polyester materials and polysaccharide polymers or combinations therefore.

A further advantage is achievable through the use of nanofibre materials as a base for catalytic substances to enhance filter performance. Nanofibres have a sufficiently high surface area to volume ratio to have the potential for catalytic activity. Such nanofibres may be added to a filter using the apparatus of FIG. 2, for instance at the time of additive loading through the one or more hoppers in the filter bander 24 such that the nanofibres are metered into the airstream within the filter bander 24.

Figure 7:
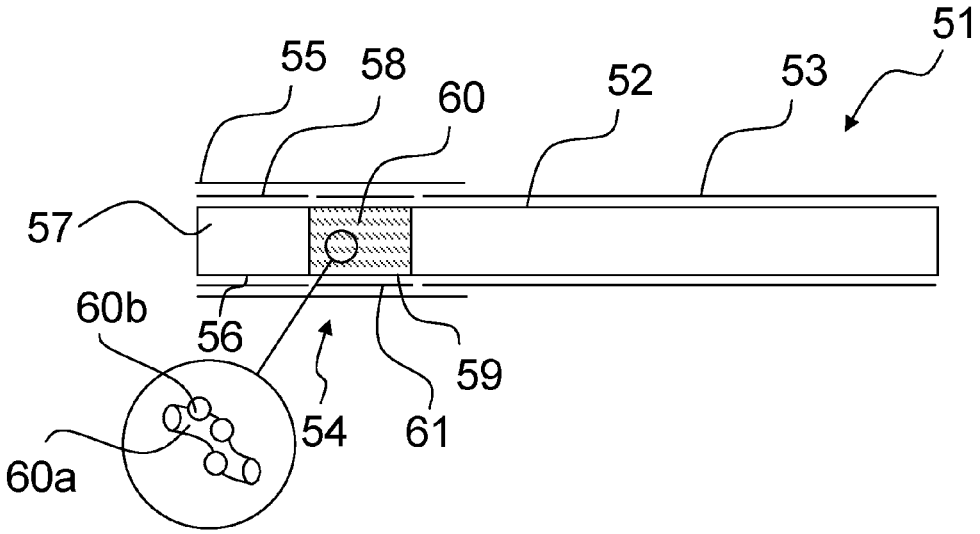
FIG. 7 is a schematic illustration of a smoking article having a filter with at least one segment including a nanofibre carrying an additive for enabling or enhancing the reduction of at least one component of main stream smoke.

FIG. 7 is a schematic illustration of a smoking article 51 having a filter including a nanofibre carrying an additive for enhancing or enabling the reduction of at least one component of main stream smoke drawn through the smoking article 51 when in use.

Referring to FIG. 7, the smoking article 51 comprises a tobacco rod 52 wrapped in a wrapping material 53, in this case cigarette paper, connected longitudinally to a filter 54 by tipping material 55 overlaying the filter 54 and partially overlaying the wrapping material 53. The filter 54 comprises a first segment 56 at the mouth-end of the filter 54 comprising crimped cellulose acetate tow 57 wrapped in a first plug wrap 58, and a second segment 59 at the tobacco rod end of the filter 54 comprising nanofibres 60 wrapped in a second plug wrap 61. The first segment 56 is a cellulose acetate segment formed using continuous cellulose acetate fibres and a plasticiser. In the present example the nanofibres 60 are short length randomly oriented fibres mixed with cellulose acetate short length randomly oriented fibres. The nanofibres comprise carbon nanofibres 60*a* supporting zinc oxide (ZnO) particles acting as a catalytic agent 60*b*, for instance enhancing the reduction of HCN in cigarette smoke. In alternative embodiments, other nanofibre materials and/or other catalytic agents can be used, alone or in combination (including in combination with carbon and/or ZnO), such as Gold (Au), for instance for Carbon Monoxide (CO) reduction from cigarette smoke. The nanofibres 60 can be added as an additive to randomly orientated staple length cellulose acetate fibres using the filter making apparatus 20 of FIG. 2.

The nanofibres can be of any suitable length for inclusion in a filter segment, for instance between 1 mm and 15 mm, or from 5 mm to 12 mm. The diameters of the nanofibres used can be from 25 nm to 900 nm, or from 50 nm to 500 nm, or from 100 nm to 300 nm.

In further embodiments of the invention, where local regulations permit, flavour may be provided to filters produced using the Turmalin apparatus.

The addition of flavour to a filter can be achieved using a thread as a carrier. An example of suitable apparatus for inserting threads into filter material is provided in patent publication no. WO2010/108739 and corresponding U.S. patent application publication of U.S. application Ser. No. 13/259,634, the contents of which are incorporated by reference herein. A Thread insertion device, such as that described in WO2010/108739, can be installed in a central portion of the filter vacuum band with a thread inserting needle carrying the thread into the axial region of the filter rod as it is formed. Embodiments described herein involving the insertion of threads into filters are particularly advantageous in slim and super slim formats, i.e. below 22 mm diameters, and in particular below 21 mm, 20 mm, 18 mm, 16 mm, 15 mm and 14 mm.

Figure 8:
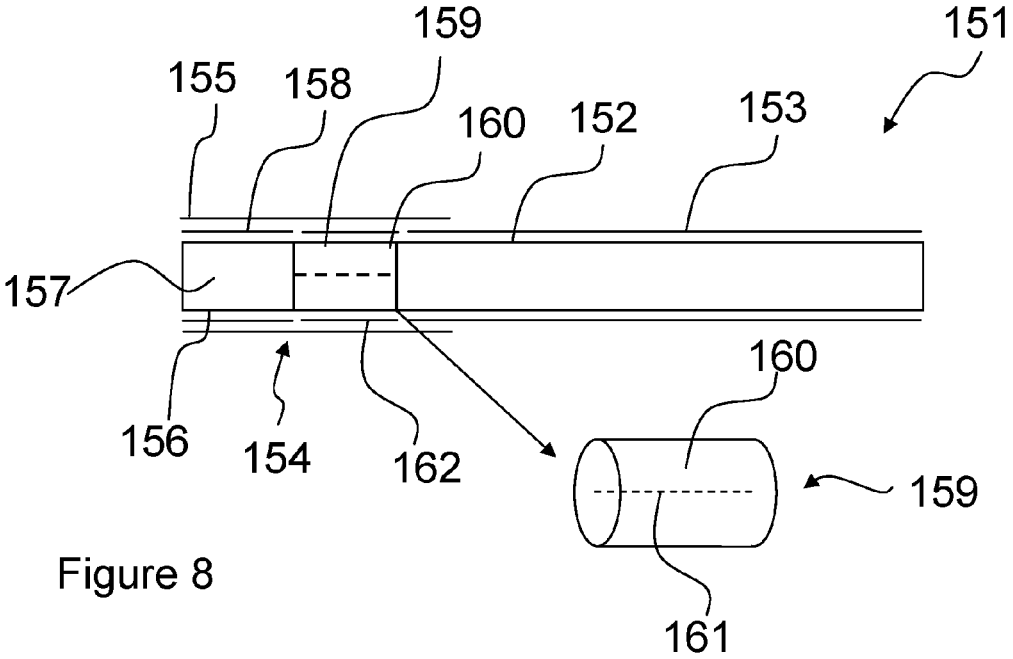
FIG. 8 is a schematic illustration of a smoking article having a filter with at least one segment comprising randomly oriented discrete short length fibres having a thread extending therethrough.

FIG. 8 is a schematic illustration of a smoking article having a filter comprising randomly oriented discrete short length fibres having a thread extending therethrough.

Referring to FIG. 8, the smoking article 151 comprises a tobacco rod 152 wrapped in a wrapping material 153, in this case cigarette paper, connected longitudinally to a filter 154 by tipping material 155 overlaying the filter 154 and partially overlaying the wrapping material 153. The filter 154 comprises a first segment 156 at the mouth-end of the filter 154 comprising crimped cellulose acetate tow 157 wrapped in a first plug wrap 158, and a second segment 159 at the tobacco rod end of the filter 154 comprising absorbent material 160. A thread 161 extends axially through the second segment 159. The second segment 159 is wrapped in a second plug wrap 162. In the present example the absorbent material 160 comprises randomly oriented discrete short length cellulose acetate fibres.

The inventors have also appreciated that the Turmalin apparatus, or similar, may be arranged to permit the inclusion into randomly oriented discrete short length fibre filters of capsules, microcapsules or other encapsulated material, while ensuring uniform distribution of the capsule contents, such as flavour (where local regulations permit) or diluents.

In a similar manner as described in relation to carbon loading, it is possible to add such materials at higher levels in order to deliver more flavour. Capsules, whether larger capsules such as those with diameters between 3 mm and 8 mm, microcapsules or other encapsulated materials, can be pushed into filter tow in an apparatus such as the Turmalin apparatus by directing the capsules through a tube into the filter tow at the downstream end of the filter bander. The capsules can, for instance, be blown into the filter material using high pressure gas, at a frequency corresponding to the speed of the filter bander, such that capsules are located in the resulting filter rod at appropriate intervals, and filter segments cut from the filter rod contain the desired number of capsules. Alternatively, microcapsules could be metered onto the filter band in a similar way to additives, using one of the additive hoppers described above. Embodiments described herein involving the insertion of encapsulated flavourants into filters are particularly advantageous in slim and super slim formats, i.e. below 22 mm diameters, and in particular below 21 mm, 20 mm, 18 mm, 16 mm, 15 mm and 14 mm.

Figure 9:
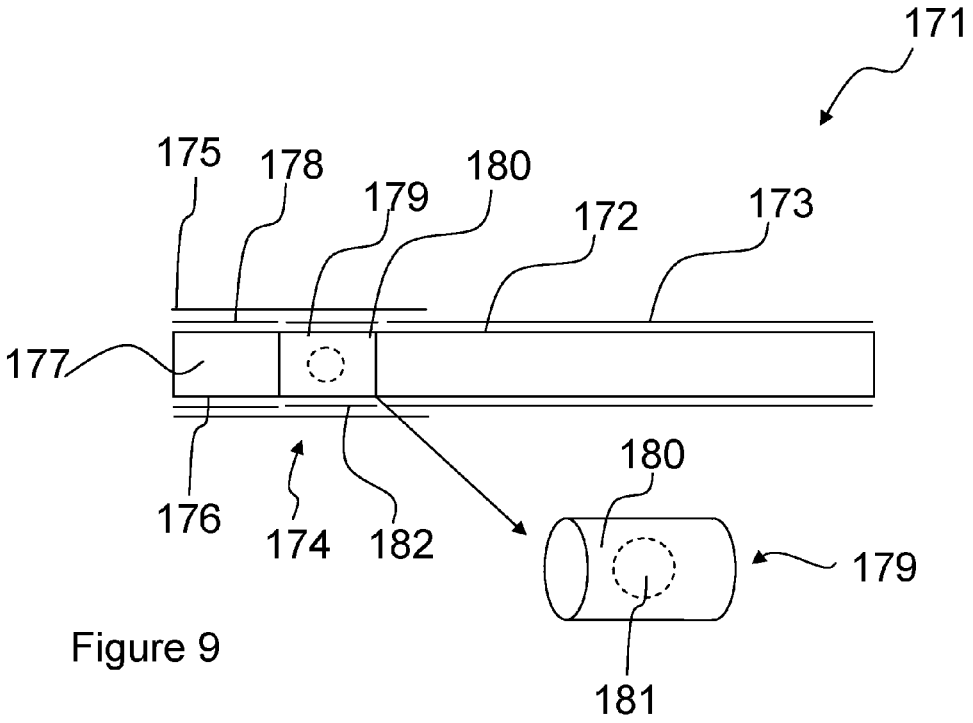
FIG. 9 is a schematic illustration of a smoking article having a filter with at least one segment comprising randomly oriented discrete short length fibres having a capsule disposed therein.

FIG. 9 is a schematic illustration of a smoking article 171 having a filter comprising randomly oriented discrete short length fibres having a capsule disposed therein. Referring to FIG. 9, the smoking article 171 comprises a tobacco rod 172 wrapped in a wrapping material 173, in this case cigarette paper, connected longitudinally to a filter 174 by tipping material 175 overlaying the filter 174 and partially overlaying the wrapping material 173. The filter 174 comprises a first segment 176 at the mouth-end of the filter 174 comprising crimped cellulose acetate tow 177 wrapped in a first plug wrap 178, and a second segment 179 at the tobacco rod end of the filter 174 comprising absorbent material 180. An encapsulated flavourant 181, in the present case in the form of a capsule, is disposed within second segment 179. The second segment 179 is wrapped in a second plug wrap 182. In the present example the absorbent material 180 comprises randomly oriented discrete short length cellulose acetate fibres.

Figure 10:
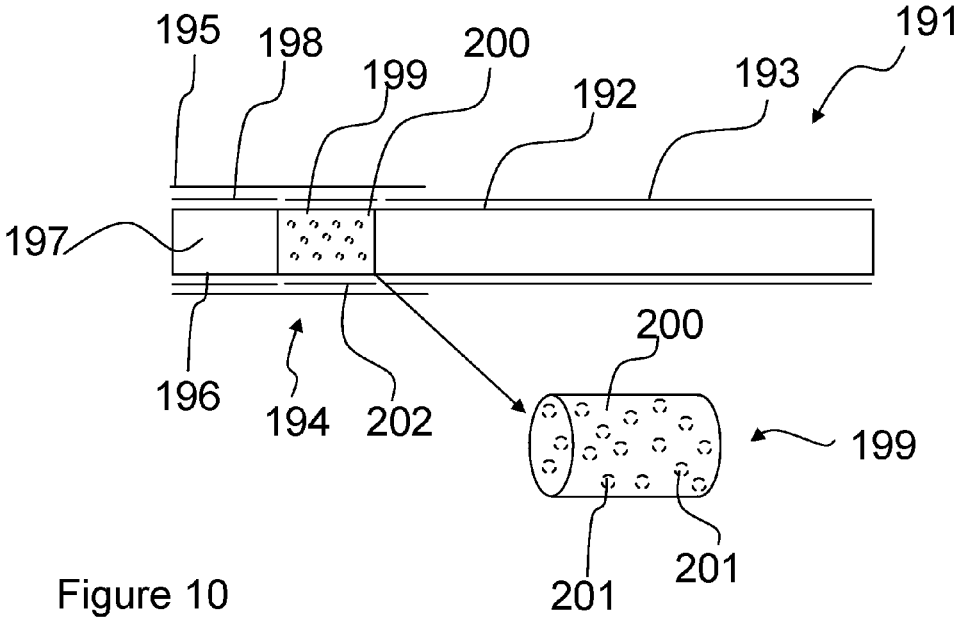
FIG. 10 is a schematic illustration of a smoking article having a filter with at least one segment comprising randomly oriented discrete short length fibres having microcapsules disposed therein.

FIG. 10 is a schematic illustration of a smoking article having a filter comprising randomly oriented discrete short length fibres having microcapsules disposed therein.

Referring to FIG. 10, the smoking article 191 comprises a tobacco rod 192 wrapped in a wrapping material 193, in this case cigarette paper, connected longitudinally to a filter 194 by tipping material 195 overlaying the filter 194 and partially overlaying the wrapping material 193. The filter 194 comprises a first segment 196 at the mouth-end of the filter 194 comprising crimped cellulose acetate tow 197 wrapped in a first plug wrap 198, and a second segment 199 at the tobacco rod end of the filter 194 comprising absorbent material 200. Encapsulated flavourant 201, in the present case in the form of a plurality of microcapsules, is disposed within second segment 199. The second segment 199 is wrapped in a second plug wrap 202. In the present example the absorbent material 200 comprises randomly oriented discrete short length cellulose acetate fibres.

In addition to encapsulated flavourants, other forms of flavour additive (where local regulations permit the use of such additives) can be added to a filter comprising randomly oriented discrete short length fibres. For instance, flavour additives could be added in botanical form, such as mint or tobacco leaves or other plant leaves, plant seeds, plant peel etc. Such additives can be added to the additive hoppers in the band former of the Turmalin apparatus and therefore metered into the filter material air stream as the filter band is formed, for instance using discrete short length cellulose acetate fibres as described herein. Since no plasticiser is used in the randomly oriented discrete short length fibre filter, flavour release from botanical additives can be enhanced.

It is envisaged by the inventors that additional materials not previously used in filter manufacturing may be used in manufacture using a Turmalin apparatus or similar.

In one embodiment, shredded sheet materials, including new sheet materials, are included within the filter material. Such sheet materials include sheet materials formed from botanicals, such as mint and or menthol, tobacco or reconstituted tobacco. A person skilled in the art will appreciate that the list provided is not limiting and that any suitable sheet material may be used. The benefits of using such sheet materials in shredded form are that they can improve the dispersibility of the material within the filter and also improve the degradability of the filter material. Furthermore, the use of new materials may be used to improve the performance of the filter and/or modify characteristics of smoke drawn through the filter.

Figure 11:
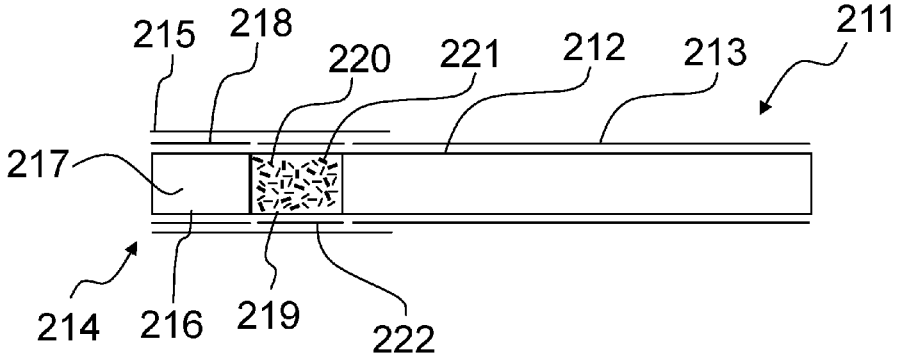
FIG. 11 is a schematic illustration of a smoking article having a filter with at least one segment comprising randomly oriented discrete short length fibres having shredded sheet material disposed therein.

FIG. 11 is a schematic illustration of a smoking article having a filter comprising randomly oriented discrete short length fibres having shredded sheet material disposed therein.

Referring to FIG. 11, the smoking article 211 comprises a tobacco rod 212 wrapped in a wrapping material 213, in this case cigarette paper, connected longitudinally to a filter 214 by tipping material 215 overlaying the filter 214 and partially overlaying the wrapping material 213. The filter 214 comprises a first segment 216 at the mouth-end of the filter 214 comprising crimped cellulose acetate tow 217 wrapped in a first plug wrap 218, and a second segment 219 at the tobacco rod end of the filter 214 comprising absorbent material 220 in which shredded sheet material 221 is dispersed. The second segment 219 is wrapped in a second plug wrap 222. In the present example the absorbent material 200 comprises randomly oriented discrete short length cellulose acetate fibres and the shredded sheet material 221 comprises shredded reconstituted tobacco sheet.

The shredded sheet material 221 can comprise a material formed from fibres of cellulose acetate, polyvinyl alcohol (PVOH), polylactic acid (PLA), poly(ϵ-caprolactone) (PCL), poly(1-4 butanediol succinate) (PBS), poly(butylene adipate-co-terephthalate) (PBAT), starch based materials, paper, aliphatic polyester materials or polysaccharide polymers and/or combinations therefore.

The inventors have also appreciated the potential for combining degradable or otherwise alternative fibres such as PVOH fibres with conventional cellulose acetate fibres. PVOH is typically not used in conventional filter manufacture because PVOH cannot usually be crimped. The inclusion of PVOH or other non-crimped fibres with another material, i.e. cellulose acetate, mean that this problem can be overcome. Using such materials can result in a filter with improved degradability and water solubility. Other materials include poly(ϵ-caprolactone) (PCL), poly(1-4 butanediol succinate) (PBS), poly(butylene adipate-co-terephthalate) (PBAT), starch based materials, paper, aliphatic polyester materials and polysaccharide polymers.

Also, other crimped materials such as PLA can be combined with conventional cellulose acetate fibres.

In one embodiment, in order to add PVOH or other non-crimped fibres to a filter, or PLA or other crimped fibres to a filter, the Turmalin feeder 22 is arranged to feed two ropes of raw filter material into the cutter and randomiser 23. As such, the number of processing steps is reduced by not first turning the material into sheet material, and instead pulling the material straight in as tow.

In addition, the number processing steps may be further reduced if the step for turning material into tow material is omitted. In such embodiments, there is further no requirement to feed, cut and randomise the fibres. Rather, the PVOH, PLA or other material in raw fibrous form can be mixed directly with a bag of short staple cellulose acetate fibres lanced straight into the Turmalin apparatus.

In another embodiment, PVOH fibres (or other non-crimped fibres) or PLA fibres (or other crimped fibres) can be metered into the filter tow in the filter bander 24 using one of the additive hoppers described above.

Figure 12:
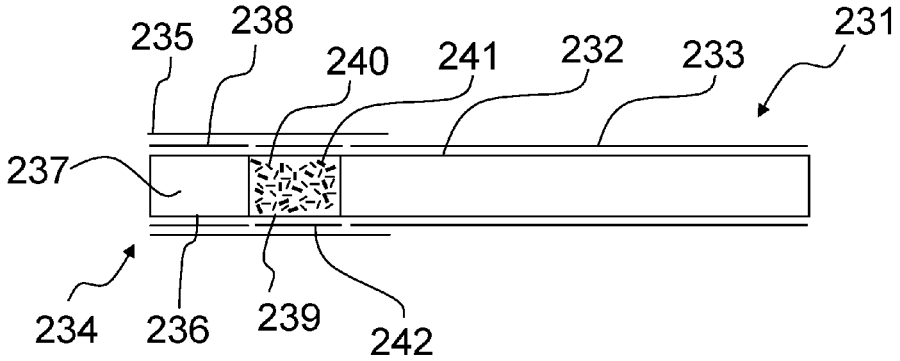
FIG. 12 is a schematic illustration of a smoking article having a filter with at least one segment comprising randomly oriented discrete short length fibres having degradable fibres disposed therein.

FIG. 12 is a schematic illustration of a smoking article having a filter comprising randomly oriented discrete short length fibres having degradable fibres disposed therein. Referring to FIG. 12, the smoking article 231 comprises a tobacco rod 232 wrapped in a wrapping material 233, in this case cigarette paper, connected longitudinally to a filter 234 by tipping material 235 overlaying the filter 234 and partially overlaying the wrapping material 233. The filter 234 comprises a first segment 236 at the mouth-end of the filter 234 comprising crimped cellulose acetate tow 237 wrapped in a first plug wrap 238, and a second segment 239 at the tobacco rod end of the filter 234 comprising absorbent material 240 in which PVOH fibres 241 are dispersed. The second segment 239 is wrapped in a second plug wrap 242. In the present example the absorbent material 240 comprises randomly oriented discrete short length cellulose acetate fibres.

Conventional filter manufacturing techniques manufacture filter rods with a uniform density in a longitudinal direction. The inventors have appreciated that it is possible to purposely provide variable density along the length of the filter rod. In one embodiment the density may be caused to vary such that when the filter rod is cut into individual segments, the filter segment comprises dense ends, and a centre portion of lower density. This is advantageous as it does not rely on the tow crimp to hold fibres in the filter.

Figure 13A:
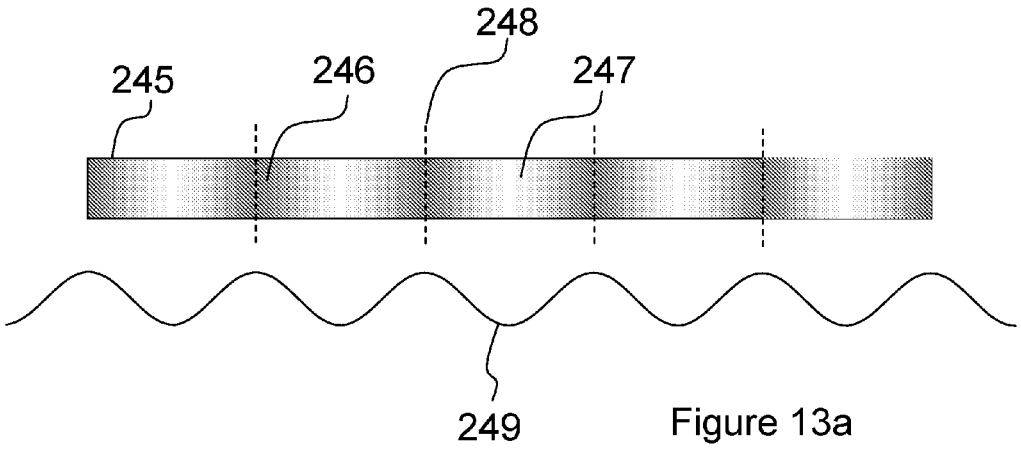
FIG. 13*a* is a schematic illustration of a filter rod comprising regions of higher average density and regions of lower average density.

FIG. 13*a* is a schematic illustration of a filter rod 245 comprising alternately arranged longitudinal regions 246 of higher average density and regions 247 of lower average density. The filter rod 245 can be used to produce multiple filter segments, each comprising a homogeneous unit of filter material, for instance varying only in density along its length, for use in smoking article filters. For instance, the filter rod 245 can be cut at the centre 248 of each of the regions 246 of higher average density such that the resulting filter segments have 'dense ends'. Line graph 249 illustrates the density of filter material along the length of the filter rod 245, in the present example varying in an undulating or sinusoidal manner. In alternative examples, the density of filter material along the length of the filter rod 245 can vary in other ways, for instance in a sequence of 1, 2, 3, 4 or more stepped variations in the density for each density cycle along the length of the filter rod 245. The filter material illustrated in FIG. 13*a* comprises discrete short length cellulose acetate fibres, but can alternatively be another fibrous filter material described herein, such as polyvinyl alcohol (PVOH), polylactic acid (PLA), poly(ϵ-caprolactone) (PCL), poly(1-4 butanediol succinate) (PBS), polybutylene adipate-co-terephthalate) (PBAT), starch based materials, paper, aliphatic polyester materials and polysaccharide polymers or combinations therefore. The material can also contain additives, such as adsorbents as herein described.

The denser portions, as shown in FIG. 13*a*, are such that the fibres, even if some or all of the fibres are not crimped, are prevented from spilling out of filter segments, once cut. The embodiment of FIG. 13*a* accordingly can enable the use of materials which are not suitable for crimping, for example PVOH and non-woven materials. This, in turn, can lead to increased degradability and water solubility as described above. The filter material can therefore be formed from a single fibrous material, or multiple combined materials such as cellulose acetate fibres combined with those of another material.

A person skilled in the art will appreciate different ways in which the density of the filter rod 245 may be caused to vary along its length. For example, this could be achieved by using machinery having a variable speed garniture or pulsing higher volumes of filter material, or additives, when forming filter material onto a suction band. Alternatively or in addition, the filter suction band can be adapted to enable regions of higher average density and regions of lower average density to be formed on the band, for instance by varying the air resistance of the band in different regions such as by varying the size and/or frequency of apertures on the band according to the desired density pattern. The timing of the production line can be controlled such that the segment lengths are controlled and cut accordingly.

Figure 13B:
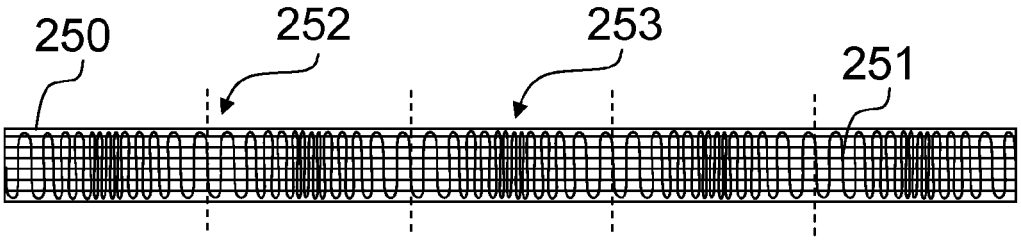
FIG. 13*b* is a schematic illustration of a section of a filter forming band for producing filter segments having regions of higher average density and regions of lower average density.

FIG. 13*b* is a schematic illustration of a section of a filter forming suction band, such as that used in the filter bander 24 of the Turmalin apparatus, for producing filter segments having regions of higher average density and regions of lower average density. Referring to FIG. 13*b*, the filter forming suction band 250 comprises a nylon mesh 251 formed so as to have first regions 252 having larger mesh apertures and a lower density of mesh material and second regions 253 having smaller mesh apertures and a higher density of mesh material. The first regions 252 accordingly have a lower resistance to air than the second regions 253. In use, the fibres in the filter bander air stream will be drawn towards the first regions 252 having larger mesh apertures with greater force than towards the second regions 253 having smaller mesh apertures. As a result, a greater average density of filter fibres will be deposited in the first regions 252 than in the second regions 253. The resulting filter will therefore have regions of greater average density corresponding to the first regions 252 of the suction band 250 and regions of lower average density corresponding to the second regions 253 of the suction band 250.

In the example of FIG. 13*b*, the size and number of apertures is varied along the length of the suction band 250 in an undulating manner. However, in other embodiments, only the size of the apertures can be varied along the length of the suction band, for instance by using a solid band with varying aperture sizes cut into the band at different longitudinally spaced repeating intervals. Alternatively, in other embodiments, only the number of apertures is varied along the length of the suction band, for instance by using a solid band with varying numbers of apertures for a given area of band cut into the hand at different longitudinally spaced repeating intervals along the band. Also, rather than following an undulating variation in air resistance along the length of the suction band, the apertures can be arranged such that 1, 2, 3, 4 or more step changes in the density of filter material occur in repeating intervals along the length of the band.

The inventors have also realised that it is possible to create filters having a non-conventional cross-sections. In conventional filter rods, if a non-circular shape was desired it would require a substantial quantity of plasticiser and steam to form the required shape. In practice this has not been readily achievable. However, the inventors have appreciated that the way in which the Turmalin apparatus creates an oblong band which has a mechanical strength can be adapted for other cross-sectional shapes of the filter material. For instance, the Turmalin apparatus could be adapted to create a band other than an oblong or the filter material can be forced into a desired shape, for instance via a shaped aperture or using an appropriately shaped garniture belt. For example, the band of filter material may be formed on the belt of the filter bander 24 or passed through an appropriately shaped aperture or garniture belt, such that the filter has a polygonal, for instance triangular, square, rectangular, pentagonal or hexagonal cross-section, or another non-circular cross-section, such as an oval or elliptical cross-section, and the structural stability of the band of material can be such that the band maintains the desired shape. Another embodiment may make use of appropriately designed wrapping and steaming processes. The resulting filter may have a cross section with a circumference smaller than 16 mm or a circumference greater than 25 mm.

Figure 14:
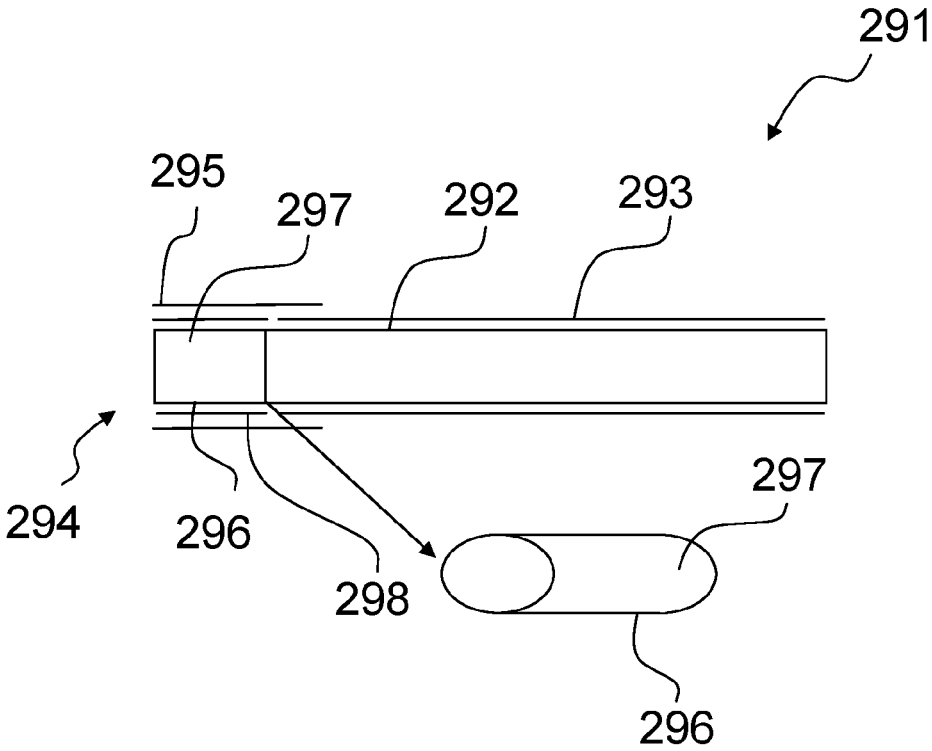
FIG. 14 is a schematic illustration of a smoking article having a filter comprising an elliptical cross-section.

FIG. 14 is a schematic illustration of a smoking article 291 having a filter comprising an elliptical cross-section.

Referring to FIG. 14, the smoking article 291 comprises an elliptically cross-sectioned tobacco rod 292 wrapped in a wrapping material 293, in this case cigarette paper, connected longitudinally to a filter 294 by tipping material 295 overlaying the filter 294 and partially overlaying the wrapping material 293. The filter 294 comprises a single filter segment 296 at the mouth-end of the smoking article 291 comprising absorbent material 297 wrapped in a first plug wrap 2980. The segment 296 has an elliptical cross-section. In the present example the absorbent material 297 comprises randomly oriented discrete short length cellulose acetate fibres. An additional plastic mesh, a fabric, or other permeable barrier (not shown) can be applied across the mouth-end of the filter 294 to prevent individual filter fibres from coming away from the filter 294.

Figure 15:
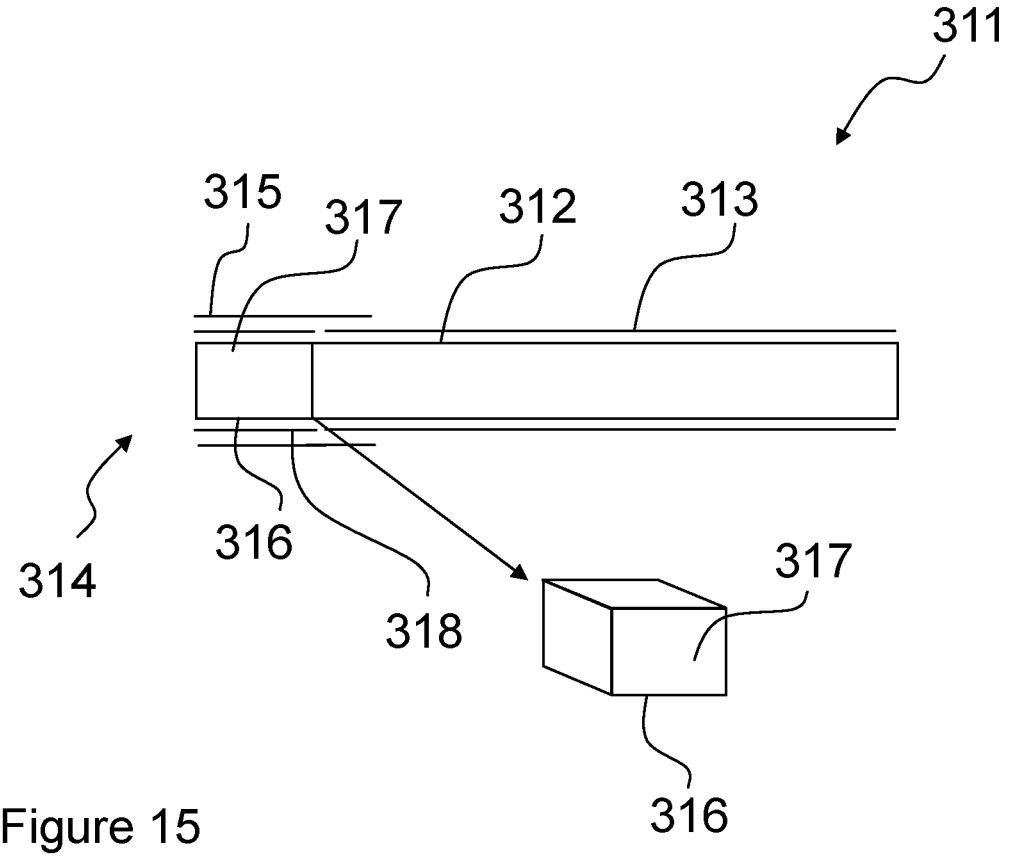
FIG. 15 is a schematic illustration of a smoking article having a filter comprising a square cross-section.

FIG. 15 is a schematic illustration of a smoking article 311 having a filter comprising a square cross-section.

Referring to FIG. 15, the smoking article 311 comprises a square cross-sectioned tobacco rod 312 wrapped in a wrapping material 313, in this case cigarette paper, connected longitudinally to a filter 314 by tipping material 315 overlaying the filter 314 and partially overlaying the wrapping material 313. The filter 314 comprises a single segment 316 at the mouth-end of the smoking article 311 comprising absorbent material 317 wrapped in a plug wrap 318. The segment 316 has a square cross-section. In the present example the absorbent material 317, 320 comprises randomly oriented discrete short length cellulose acetate fibres. An additional plastic mesh, a fabric, or other permeable barrier (not shown) can be applied across the mouth-end of the filter 314 to prevent individual filter fibres from coming away from the filter 314.

The filters 294, 314 of the embodiments illustrated in FIGS. 14 and 15 can also include other features, such as additives dispersed within the filter fibres and/or ventilation applied to the filters, for instance as laser formed holes.

The inventors have also realised that it is possible to produce filters including randomly orientated short-length fibres formed into a cylinder having a circumference smaller than 16 mm, 15 mm, 14 mm or 13 mm, or a circumference greater than 25 mm, 26 mm, 27 mm or 28 mm. A single denier fibre can be used, for instance having a denier from about 7 to about 9, and the amount used in the filter per mm varied according to the filter circumference required. For instance, the amount of randomly orientated short-length fibres per mm can be reduced for super slim format filters and increased for regular format filters. This differs from known continuous tow filter manufacture where different fibre deniers are usually required for different circumference filters.

In the foregoing examples, the second filter segments 9, 39, 59, 159, 179, 199, 219 and 239 (shown in FIGS. 1 and 6 to 12) containing randomly oriented discrete length fibres have been described as tobacco-end components of dual filters, with known cellulose acetate first filter segments at the mouth-end. However, other arrangements are possible. For instance, the second segments can be adapted for use at the mouth end of cigarette filters. This can be achieved by preventing individual fibres from coming away from the filter segment during use, for instance by including a plasticiser (for instance a localised plasticiser in a portion at the mouth end of the mouth-end segment) to hold the randomly oriented discrete length fibres and/or any additives dispersed therein in place, or by using a plastic mesh, a fabric, or other permeable barrier preventing individual fibres from reaching the mouth of a consumer. The second filter segments can also be used as the central or tobacco-end filter segment of a three-part filter, or any segment of a four, five or six-part filter, as required. The first filter segments can also be other than conventional cellulose acetate segments wrapped in plug wrap. For instance, non-wrapped acetate (NWA) sections can be used as the first filter segments described herein.

Also, the first and second filter segments of the embodiments illustrated in FIGS. 1 and 6 to 12 have been shown to have individual plug wraps and be held together and connected to the tobacco rod using a tipping material. However, alternatively, a further outer plug wrap (not shown) can be wrapped around the first and second filter segments and used to connect the first and second filter segments to each other, and the combined filter unit can then be connected to the tobacco rod using a tipping material.

Although the randomly oriented fibres described herein have been described as being crimped, non-crimped fibres can also be used, alone or mixed with crimped fibres. Also, the randomly oriented fibres have been described as being of 10 mm fibre lengths (when extended), or lengths in the range from 5 mm to 25 mm, or from 6 mm to 20 mm, 7 mm to 20 mm or 7 mm to 15 mm. The second segments can also include average fibre lengths outside this range, and/or mixtures of groups fibres of different average lengths, depending on the requirement of the filter concerned and the fibrous materials available.

Filter arrangements described herein can be modified to include one or more transparent sections in the plug wrap and/or tipping paper so as to allow the internal filter parts to be seen by smoking article consumers. For instance, the second plug wrap used to wrap the second filter segment may comprise a transparent material such as Natureflex™ film available from Innovia Films in the United Kingdom. The tipping could comprise one or more window cut-outs, or sections of transparent material such as Natureflex™ film, to enable the internal filter parts to be seen through the tipping and plug wrap. Alternatively, the tipping could be applied in two bands with a gap between them revealing the transparent plug wrap beneath, or the tipping could be made entirely of a material such as Natureflex™ film. Some embodiments may include transparent 'window' section filters such as those described in patent publication no. WO2009/106374, the contents of which (including any corresponding US publications) are incorporated by reference in their entirety herein.

In order to address various issues and advance the art, the entirety of this disclosure shows by way of illustration various embodiments in which the claimed invention(s) may be practiced and provide for superior smoking article filters. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A filter for a smoking article, the filter having a length and a circumference and comprising an adsorbent material dispersed within randomly oriented discrete short length cellulose acetate fibers, wherein the amount of adsorbent material in mg, $C_W$, per mm in length of the filter, and the amount of randomly oriented discrete short length cellulose acetate fibers in mg, $T_W$, per mm in length of the filter, for a filter circumference of about 23 mm to about 25 mm, are in accordance with the range:

$$10<(C_W+T_W)<20,$$

and wherein the amount of adsorbent material, for a filter circumference of about 23 mm to about 25 mm, is equal to or greater than 6 mg per mm in length of the filter.

2. The filter according to claim 1, wherein the amount of adsorbent material and the amount of randomly oriented discrete short length cellulose acetate fibers, per mm in length for a filter having a circumference of about 23 mm to about 25 mm, are in accordance with the range:

$$11<(C_W+T_W)<18.$$

3. The filter according to claim 1, wherein the amount of adsorbent material and the amount of randomly oriented discrete short length cellulose acetate fibers, per mm in length for a filter having a circumference of about 23 mm to about 25 mm, are in accordance with the range:

$$12<(C_W+T_W)<17.$$

4. The filter according to claim 1, wherein for a filter having a circumference of about 23 mm to about 25 mm:

the amount of adsorbent material is in a range from 6 mg to 16 mg per millimeter of length of the filter; and the amount of randomly oriented discrete short length cellulose acetate fibers is in a range from 1.5 mg to 8 mg per millimeter of length of the filter.

5. The filter according to claim 1, wherein for a filter having a circumference of about 23 mm to about 25 mm:

the amount of adsorbent material is in a range from 8 mg to 16 mg per millimeter of length of the filter; and the amount of randomly oriented discrete short length cellulose acetate fibers is in a range from 3.5 mg to 5 mg per millimeter of length of the filter.

6. The filter according to claim 1, wherein the randomly oriented discrete short length cellulose acetate fibers are held together in the filter without the use of a plasticizer.

7. The filter according to claim 6, wherein the randomly oriented discrete short length fibers have an average length of about 5 mm to about 20 mm when extended.

8. The filter according to claim 6, wherein the randomly oriented discrete short length fibers have an average fiber denier in a range of 5 to 9.

9. The filter according to claim 1, wherein the filter further comprises randomly oriented short length fibers formed from a second material other than cellulose acetate.

10. The filter according to claim 9, wherein the second material comprises a non-crimped material.

11. The filter according to claim 9, wherein the second material comprises at least one material selected from polyvinyl alcohol (PVOH), polylactic acid (PLA), poly(ϵ-caprolactone)(PCL), poly(1-4 butanediol succinate)(PBS), poly (butylene adipate-co-terephthalate)(PBAT), starch based materials, paper, aliphatic polyester materials and polysaccharide polymers.

12. The filter according to claim 1, wherein the adsorbent material comprises particles with an average diameter in the range of approximately 0.1 mm to 1 mm.

13. The filter according to claim 1, wherein the adsorbent material comprises activated carbon.

14. The filter according to claim 1, wherein the adsorbent material comprises at least one of: an ion exchange resin, CR20, zeolite, silica gel, meerschaum, activated aluminum oxide, non-activated aluminum oxide, carbonaceous resin, magnesium silicate, Sepiolite ($Mg_4Si_6O_{15}(OH)_2 \cdot 6H_2O$)), or a combination thereof.

15. The filter according to claim 1, having a pressure drop in the range of 3.47 mmWg/mm of length to 4.86 mmWg/mm of length.

16. The filter according to claim 1, having a hardness of between 85% and 95% according to the Filtrona filter hardness measure.

17. A smoking article, comprising, a filter having a length and a circumference and including:

randomly oriented discrete short length cellulose acetate fibers; and an adsorbent material dispersed within the randomly oriented discrete short length cellulose acetate fibers, the amount of adsorbent material in mg, $C_W$, per mm in length of the filter, and the amount of randomly oriented discrete short length cellulose acetate fibers in mg, $T_W$, per mm in length of the filter, for a filter circumference of about 23 mm to about 25 mm, being in accordance with the range:

$$10<(C_w+T_w)<20,$$

and the amount of adsorbent material, for a filter circumference of about 23 mm to about 25 mm, is equal to or greater than 6 mg per mm in length of the filter.

* * * * *